US008042467B2

(12) United States Patent
Schaffrath et al.

(10) Patent No.: US 8,042,467 B2
(45) Date of Patent: Oct. 25, 2011

(54) PRINTING PRESS WITH BEARER RINGS

(75) Inventors: Dieter Schaffrath, Lorsch (DE); Dirk Buchleither, Walldorf (DE); Suat Demir, Walldorf (DE); Jürgen Michels, Dossenheim (DE); Roland Müller, Hessheim (DE); Jörg Schilfahrt, Mauer (DE); Wolfgang Schönberger, Schriesheim (DE); Bernhard Schwaab, Neustadt (DE); Michael Thielemann, Heidelberg (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 492 days.

(21) Appl. No.: 12/234,902

(22) Filed: Sep. 22, 2008

(65) Prior Publication Data

US 2009/0078136 A1 Mar. 26, 2009

(30) Foreign Application Priority Data

Sep. 20, 2007 (DE) ..... 10 2007 044 826

(51) Int. Cl.

| | |
|---|---|
| ***B41F 13/21*** | (2006.01) |
| ***B41F 31/00*** | (2006.01) |
| ***B41F 7/02*** | (2006.01) |
| ***B41F 13/24*** | (2006.01) |

(52) U.S. Cl. ..... 101/351.2; 101/352.03; 101/218; 101/247

(58) Field of Classification Search ..... 101/351.1, 101/351.2, 351.3, 351.4, 352.01, 352.02, 101/352.03, 352.04, 352.05, 247, 218
See application file for complete search history.

(56) References Cited

U.S. PATENT DOCUMENTS

| | | | | |
|---|---|---|---|---|
| 4,130,042 | A | 12/1978 | Reed | |
| 5,228,390 | A * | 7/1993 | Jahn | 101/352.05 |
| 5,447,101 | A | 9/1995 | Weis | |
| 5,476,042 | A * | 12/1995 | Ehrhard et al. | 101/352.05 |
| 6,347,585 | B1 * | 2/2002 | Kiamco et al. | 101/351.1 |
| 6,886,461 | B2 * | 5/2005 | Bolza-Schunemann | 101/352.06 |

FOREIGN PATENT DOCUMENTS

| | | | |
|---|---|---|---|
| DE | 44 01 300 | A1 | 8/1994 |
| DE | 195 01 243 | C2 | 7/1996 |
| DE | 197 36 762 | A1 | 3/1999 |
| DE | 10 2005 014 255 | A1 | 10/2006 |
| EP | 0 659 554 | B1 | 6/1995 |

OTHER PUBLICATIONS

German Patent and Trademark Office Search Report, dated May 15, 2008.

* cited by examiner

*Primary Examiner* — Ren Yan
*Assistant Examiner* — Leo T Hinze
(74) *Attorney, Agent, or Firm* — Laurence A. Greenberg; Werner H. Stemer; Ralph E. Locher

(57) ABSTRACT

A printing press includes a first rotary body with a first bearer ring and a second rotary body with an axle which eccentrically supports a second bearer ring. The second bearer ring is in rolling contact with the first bearer ring and is rotatably coupled to the second rotary body.

8 Claims, 5 Drawing Sheets

PRINTING PRESS WITH BEARER RINGS

CROSS-REFERENCE TO RELATED APPLICATION

This application claims the priority, under 35 U.S.C. §119, of German Patent Application DE 10 2007 044 826.2, filed Sep. 20, 2007; the prior application is herewith incorporated by reference in its entirety.

BACKGROUND OF THE INVENTION

Field of the Invention

The invention relates to a printing press with bearer rings.

Printing press cylinders or rollers which roll on each other create flexural vibrations and rotational vibrations. The reason for the occurrence of flexural vibrations is that radial force decreases and builds up again abruptly upon the passage of cylinder gaps. That undesirable effect is known as the cylinder gap shock. The rotational vibration may have various causes. One possible cause is a rhythmical increase and decrease of a restoring torque. A reverse torque is created by the squeezing or kneading of the blanket which is attached to one of the two cylinders rolling on each other. When the blanket leaves the cylinder gap of the other cylinder, the blanket behaves in a visco-elastic manner, thus generating a force component which generates the reverse torque. Another possible cause is an effect which is known as "true rolling": a tangential force resulting from a difference in the translational ratio between the hard circumferential surface of the one cylinder and the rubber-elastic circumferential surface of the other cylinder is effective in the nip formed by the two cylinders which roll on each other. That tangential force generates a twisting torque which temporarily breaks down upon a passage of the cylinder gap and thus causes the rotational vibration. Last but not least, the rotational vibrations may also be caused by what is known as a running frequency of meshing drive gears of the cylinders.

Flexural and rotational vibrations cause visual disturbances in the printed image.

It is known to equip the cylinders which roll on each other with bearer rings to counteract the phenomena which cause vibration. Those bearer rings are support rings which are pressed against each other at a high pressing force to absorb gap-related vibration. Typically, the bearer rings are bearing races which roll on each other, thus minimizing rotational vibrations or transferring them in such a way as to avoid disturbing relative movements between the circumferential surfaces of the cylinders.

Typical bearer rings which act as support rings and as bearing races have a disadvantage. They cause the distance between the axes of rotation of the cylinders which roll on each other and are equipped with the bearer rings to be invariable. However, in certain applications, a modification of that axial distance and thus of the roller pressure between the cylinders is desirable. That is the case, for example, when the cylinders are a screen roller and an ink applicator roller in an anilox inking unit. A modification of the roller pressure between the screen roller and the ink applicator roller is advantageous in order to vary the amount of ink which is transferred from the screen roller to the ink applicator roller, for example as a function of the printing speed.

In order to solve that problem, German Published, Non-Prosecuted Patent Application DE 10 2005 014 255 A1 proposes to replace the bearer rings with support disks. Those support disks may be rectangular or trapezoidal and are supported for rotation on journals of the screen roller and the ink applicator roller by roller bearings. The screen roller and ink applicator roller are supported in a machine frame wall by rotatable eccentric bearings. A wedge-shaped support element is disposed between the support disks of the two rollers as a way of modifying the axial distance between the two rollers. The wedge-shaped support element can be moved to push apart the support disks and thus the rollers connected to the support disks.

As the support disks are pressed against each other, in an indirect way through the wedge-shaped support element, they suppress flexural vibrations. Yet since the support disks do not roll on each other, they are incapable of suppressing rotational vibration.

European Patent EP 0 659 554 B1, corresponding to U.S. Pat. No. 5,447,101, describes the use of support disks which are formed by outer rings of ball bearings located on the cylinder journals. Each of the outer rings has a sickle-shaped eccentricity which allows adjustment of the distance between the cylinder axes. The outer rings are not rings which permanently roll on their counterparts during the printing operation. Instead they are only rotated temporarily for the purpose of adjusting the distance between the cylinder axes.

German Patent DE 195 01 243 C5 describes a printing press having cylinders which roll on each other that are driven by different motors and are equipped with rings supported on each other. The rings are supported for rotation on the cylinder journals in such a way that no torque is transmittable to the respective cylinder journal by the respective ring. Due to the fact that the respective rings are not fixed against rotation relative to the respective cylinder, they are not bearer rings in the true sense of the word. Those rings are used to avoid undesired transmission of a torque from one motor to another.

SUMMARY OF THE INVENTION

It is accordingly an object of the invention to provide a printing press with bearer rings, which overcomes the hereinafore-mentioned disadvantages of the heretofore-known devices of this general type and in which the printing press has structural conditions that are favorable in terms of an adjustment of a contact pressure between rotary bodies (cylinders or rollers) and in terms of avoiding or at least reducing both flexural and rotational vibration of the rotary bodies.

With the foregoing and other objects in view there is provided, in accordance with the invention, a printing press, comprising a first rotary body with a first bearer ring, and a second rotary body with an axle eccentrically supporting a second bearer ring. The second bearer ring is in rolling contact with the first bearer ring and is rotatably coupled to the second rotary body.

In accordance with the invention, the bearer rings are support rings which are pressed against each other with a high force and are capable of absorbing the gap-related vibration of the rotary bodies and have bearing races which roll on each other during printing and minimize rotational vibration or transmit the rotary vibration in such a way as to avoid disturbing relative movements between circumferential surfaces of the rotary bodies. The bearer rings of the printing press according to the invention avoid or at least minimize complications caused by flexural vibration and complications caused by rotational vibration. Due to the fact that the second bearer ring is not supported to be concentric with the second rotary body but is offset relative to the latter in an axially parallel manner on the axis of the second rotary body, the pressure between the rotary bodies is advantageously adjustable. Torque transmission occurs between these two components due to the rotative coupling of the second bearer ring with the second rotary body.

In accordance with another feature of the invention, the second bearer ring is supported on the axle through a bearing which has an eccentric bushing. In this context, the bearing may include a first pivot bearing for supporting the eccentric bushing on the axle and a second pivot bearing for supporting the second bearer ring on the eccentric bushing. This eccentric bushing is used to adjust the second bearer ring relative to the second rotary body. The position of an eccentricity existing between the axis of rotation of the second bearer ring and the axis of rotation of the second rotary body can be adjusted by rotating the eccentric bushing, thus adjusting the pressure between the two rotary bodies. The two pivot bearings may be constructed as roller bearings, an inner one of which is disposed between the axis of the second rotary body and the eccentric bushing and an outer one of which is disposed between the eccentric bushing and the second bearer ring.

In accordance with a further feature of the invention, the second bearer ring and the rotary body are connected to each other through a compensation coupling for radial compensation. This coupling, which is movable in a transverse direction relative to the axis of rotation of the second bearer ring and the axis of rotation of the second rotary body, acts to compensate for an offset between these two axes of rotation and effects the aforementioned rotative coupling between the second bearer ring and the second rotary body. In this context, the compensation coupling may be an entrainment coupling for connecting the second bearer ring with the second rotary body so that the former rotates with the latter. The entrainment coupling transmits the rotary movement of the second rotary body to the second bearer ring. The coupling may, for example, be constructed in a manner similar to an Oldham coupling or a cross slit coupling and may thus include radial slits and pawls or entrainment bolts engaged therewith. The slits may be formed in the second bearer ring and the pawls or entrainment bolts may be disposed on the second rotary body. The pawls and slits may likewise be disposed the other way around. In accordance with a different construction of the coupling, the second bearer ring and the second rotary body are pin-jointed by links which are constructed in a manner similar to the cranks of a parallel crank coupling (Schmidt coupling). These links transmit the torque of the second rotary body to the second bearer ring. Radial compensation is achieved by a pivoting movement of the links about their pivot joints.

In accordance with an added feature of the invention, the compensation coupling is a friction coupling.

In accordance with an additional feature of the invention, the first rotary body is spring-mounted so as to be supported in a resilient manner. The spring pushes or pulls the first rotary body towards the second rotary body.

In accordance with a concomitant feature of the invention, the first rotary body is an ink applicator roller and the second rotary body is a screen roller. In this case, the two rotary bodies are inking unit rollers of an anilox inking unit of the printing press.

Other features which are considered as characteristic for the invention are set forth in the appended claims.

Although the invention is illustrated and described herein as embodied in a printing press with bearer rings, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
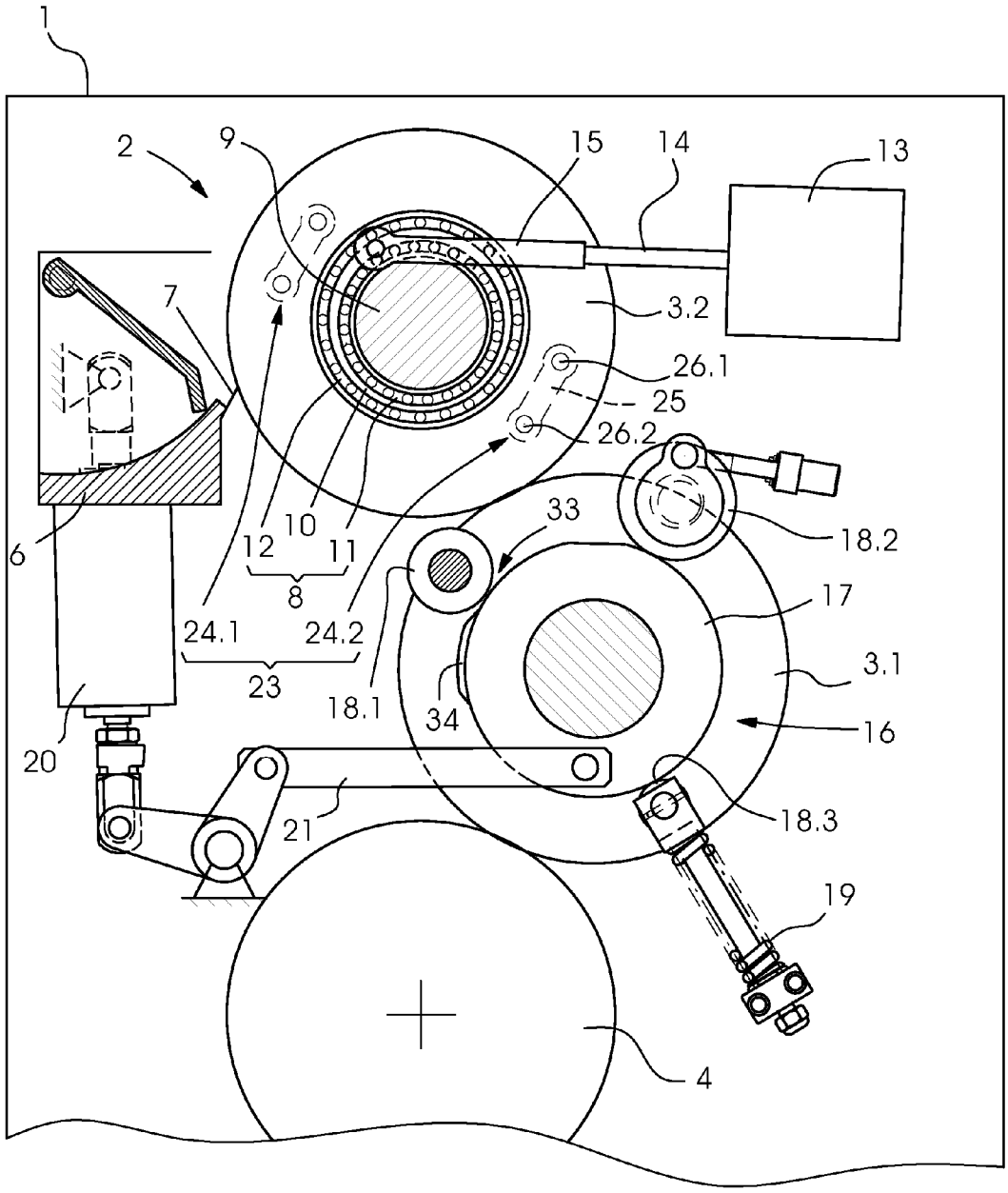
FIG. 1 is a fragmentary, diagrammatic, front-elevational view of an anilox inking unit.
Figure 2:
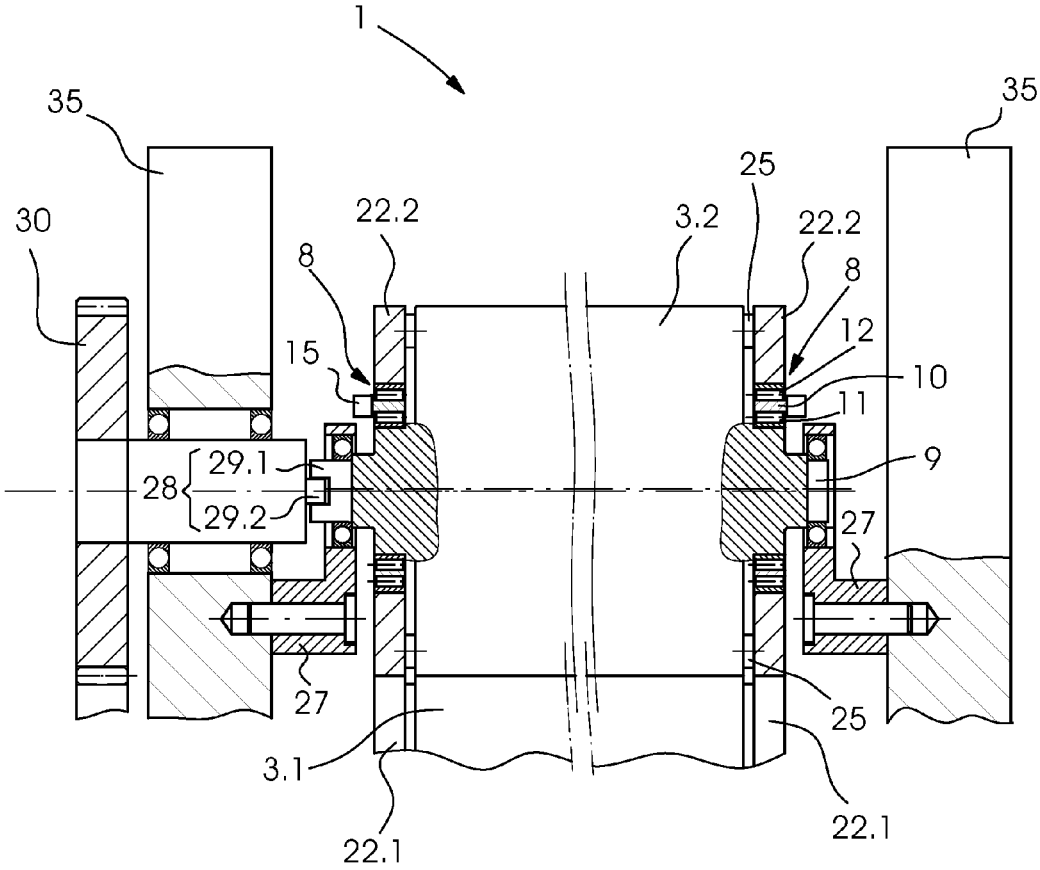
FIG. 2 is a fragmentary, side-elevational view of the anilox inking unit shown in FIG. 1.

Referring now to the figures of the drawings in detail and first, particularly, to FIGS. 1 and 2 thereof, there is seen a portion of a printing press 1. The illustrated portion is an anilox inking unit 2 of the printing press 1. The anilox inking unit 2 includes an ink applicator roller 3.1 and a screen roller 3.2 contacting the ink applicator roller 3.1. The ink applicator roller 3.1 is supported in such a way as to be engageable with and disengageable from a plate cylinder 4. An ink fountain 6 with a doctor blade 7 is associated with the screen roller 3.2. An impression cylinder and a blanket cylinder which contacts the plate cylinder 4 and the impression cylinder during printing, are non-illustrated further components of the printing press 1.

A respective bearing 8 disposed on an axle 9 of the screen roller 3.2 is located on each of the two sides of the screen roller 3.2. Each bearing 8 includes an eccentric bushing 10, a first pivot bearing 11 and a second pivot bearing 12. The eccentric bushing 10 has a bore which is not concentric relative to the outer circumference of the eccentric bushing 10. The two pivot bearings 11, 12 of the respective bearing 8 are constructed as roller bearings. The first pivot bearing 11 is located on the axis 9, whereas the eccentric bushing 10 is located on the first pivot bearing 11. The second pivot bearing 12 is located on the eccentric bushing 10. An actuating drive 13 for rotating the eccentric bushing 10 is constructed as an electric motor. The actuating drive 13 is connected to the eccentric bushing 10 by a screw drive mechanism having a screw 14 which is formed by a motor shaft of the actuating drive 13 and a nut 15 which is articulated at the eccentric bushing 10.

The ink applicator roller 3.1 can be engaged with and disengaged from the plate cylinder 4 and the screen roller 3.2 through the use of a bearing 16. The bearing 16 includes an annular control cam 17, in which the ink applicator roller 3.1 is supported for rotation. The control cam 17 is clamped between a first support roll 18.1, a second support roll 18.2, and a third support roll 18.3. The second support roll 18.2 is located on an extension of an imaginary line connecting the centers of the axes of rotation of the plate cylinder 4 and the ink applicator roller 3.1. The third support roll 18.3 is located on an extension of a line connecting the centers of the axes of rotation of the ink applicator roller 3.1 and the screen roller 3.2. The third support roll 18.3 is loaded by a spring 19 having a force which is directed between the first support roll 18.1 and the second support roll 18.2. An actuating drive 20 in the form of a pneumatic cylinder is connected to the control cam 17 through the use of rods to rotate the control cam 17 when the rollers are being engaged or disengaged.

As is shown in FIG. 2, the ink applicator roller 3.1 has a respective first bearer ring 22.1 on each of its two ends. A respective second bearer ring 22.2 is attached to each of the two ends of the screen roller 3.2. The bearing 16 (see FIG. 1) is provided twice, i.e. one on the drive side and one on the operator side of the printing press 1. The springs 19 of the bearings 16 press the first bearer rings 22.1 against the second bearer rings 22.2. In the process, the respective control cam 17 is in circumferential contact with the second support roll 18.2 and the third support roll 18.3, but not with the first support roll 18.1. An air gap 33 is present between the first support roll 18.1 and the control cam 17 when the bearer rings of the two rotary bodies (ink applicator roller 3.1 and screen roller 3.2) are in contact. When the control cam 17 is rotated in the clockwise direction with respect to FIG. 1, a protrusion 34 in the periphery of the control cam 17 is positioned opposite the first support roll 18.1 and thus contact is established between the control cam 17 and the first support roll 18.1. Such a rotation is made to disengage the ink applicator roller 3.1 from the screen roller 3.2 and thus to disengage the first bearer rings 22.1 of the ink applicator roller 3.1 from the second bearer rings 22.2 of the screen roller 3.2.

Figure 3B:
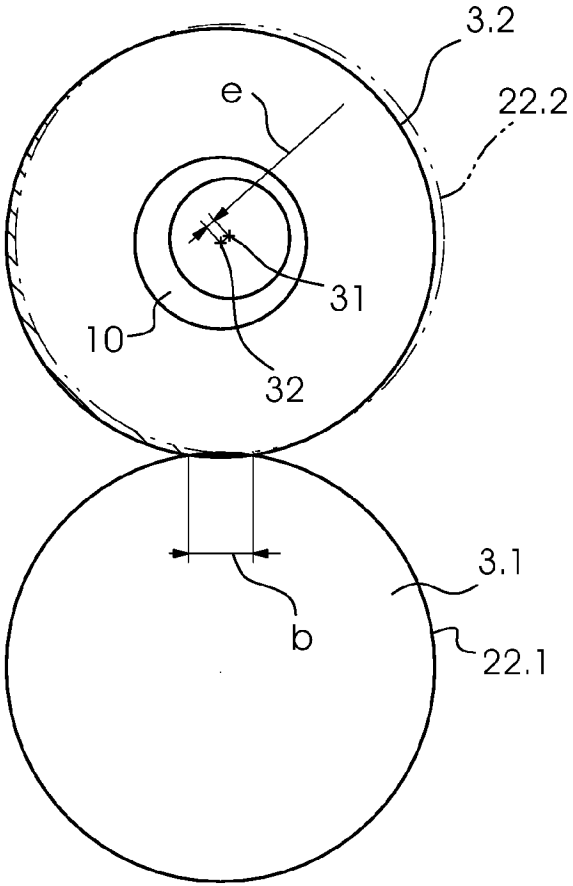
FIGS. 3A and 3B are front-elevational views illustrating different pressure settings between a screen roller and an ink applicator roller of the anilox inking unit shown in FIGS. 1 and 2.
Figure 3A:
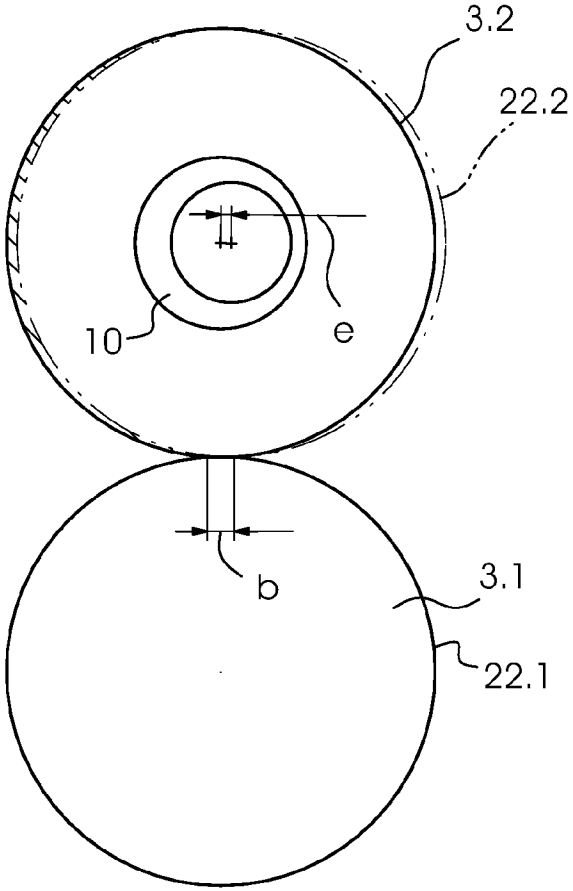

Each of the second bearer rings 22.2 is connected to the screen roller 3.2 by a coupling 23. With reference to FIGS. 3A and 3B, each coupling 23 is both a compensating coupling to compensate for any radial offset or eccentricity e between an axis of rotation 31 of the second bearer ring 22.2 and an axis of rotation 32 of the screen roller 3.2, as well as an entrainment coupling to transmit a first torque from the screen roller 3.2 to the bearer ring 22.2. Each coupling 23 includes a first connecting point 24.1 and a second connecting point 24.2 disposed diametrically opposite the first connecting point 24.1. Each connecting point 24.1, 24.2 includes a link 25. One end of the link 25 is connected to the screen roller 3.2 in a first pivot joint 26.1. The other end of the link is connected to the second bearer ring 22.2 in a second pivot joint 26.2.

The screen roller 3.2 is supported for rotation in a roller socket 27 through the use of roller bearings. The roller bearings are attached to side walls 35 of a machine frame. The screen roller 3.2 is rotatably coupled to a gearwheel 30 through a coupling 28, including a first coupling half 29.1 and a second coupling half 29.2. The screen roller 3.2 is driven to rotate through the gearwheel 30 and the coupling 28, which is constructed as a dog clutch. The first coupling half 29.1 is disposed on an end of the axle of the screen roller 3.2. The second coupling half 29.2 is disposed on a shaft through which the gearwheel 30 is supported for rotation in one of the side walls 35.

The functioning of the illustrated system will be explained below.

When the ink applicator roller 3.1 is engaged with the screen roller 3.2 and when consequently the first bearer rings 22.1 are engaged with the second bearer rings 22.2, the rubber-elastic circumferential surface, for example formed by a blanket, of the ink applicator roller 3.1, is deformed by the comparatively hard circumferential surface of the screen roller 3.2. Thus, referring to FIGS. 3A and 3B, a strip of contact having a width b is formed in the nip between the two rollers 3.1 and 3.2. The width b of this strip of contact is advantageously variable so that by modifying the width b of the strip of contact, the amount of printing ink that is transferred from the screen roller 3.2 to the ink applicator roller 3.1 can be adjusted.

In order to increase the width b of the strip of contact, the eccentric bushing 10 of each bearing 8 is rotated in such a way that the rotation causes the respective second bearer ring 22.2 of the screen roller 3.2 to move away from the first bearer ring 22.1 of the ink applicator roller 3.1. In order to illustrate this, the outer contours of the second bearer ring 22.2 are represented by dash-dotted lines in FIGS. 3A and 3B and the circumferential section within which the circumferential line of the screen roller 3.2 extends beyond the circumferential line of the second bearer ring 22.2 is shaded for highlighting purposes. If that (shaded) circumferential section is displaced towards the ink applicator roller 3.1 or towards the nip formed by the two rollers 3.1, 3.2 by rotating the eccentric bushing 10 in a counterclockwise direction with respect to FIGS. 3A and 3B, this causes the width b of the strip of contact to increase, as becomes apparent from a comparison between FIGS. 3A and 3B. FIG. 3A illustrates the original position before an adjustment of the pressure between the two rollers 3.1 and 3.2 and thus of the width b of the strip of contact. FIG. 3B illustrates the situation once this adjustment has been made. In other words, during the adjustment, the sickle-shaped region within which the peripheral line of the second bearer ring 22.2 is receded relative to the peripheral line of the screen roller 3.2 is rotated in the direction of the ink applicator roller 3.1. In the process, the springs 19 hold the first bearer rings 22.1 in contact with the second bearer rings 22.2. In order to maintain this contact between the bearer rings during the adjustment, the springs 19 urge the first bearer rings 22.1, together with the ink applicator roller 3.1 which is firmly connected to these first bearer rings 22.1, in the direction of the screen roller 3.2. This causes the pressure between the two rollers 3.1, 3.2 and thus the width b of the strip of contact to increase. Of course, a rotation of the eccentric bushing 10 in the opposite direction, i.e. in the clockwise direction, causes the pressure between the two rollers 3.1, 3.2 to be reduced and thus the width b of the strip of contact to decrease.

In order to maintain continuous and constant contact between the first bearer rings 22.1 and the second bearer rings 22.2 during the adjustment, it is necessary for one of the two rotary bodies (ink applicator roller 3.1, screen roller 3.2) which are supported in the bearer rings 22.1, 22.2 to be supported in a resilient or elastic manner. In the illustrated example, it is the ink applicator roller 3.1 which is supported in an elastic manner through the use of the springs 19. It is likewise possible to mount the screen roller 3.2 in an elastic manner.

Figure 4:
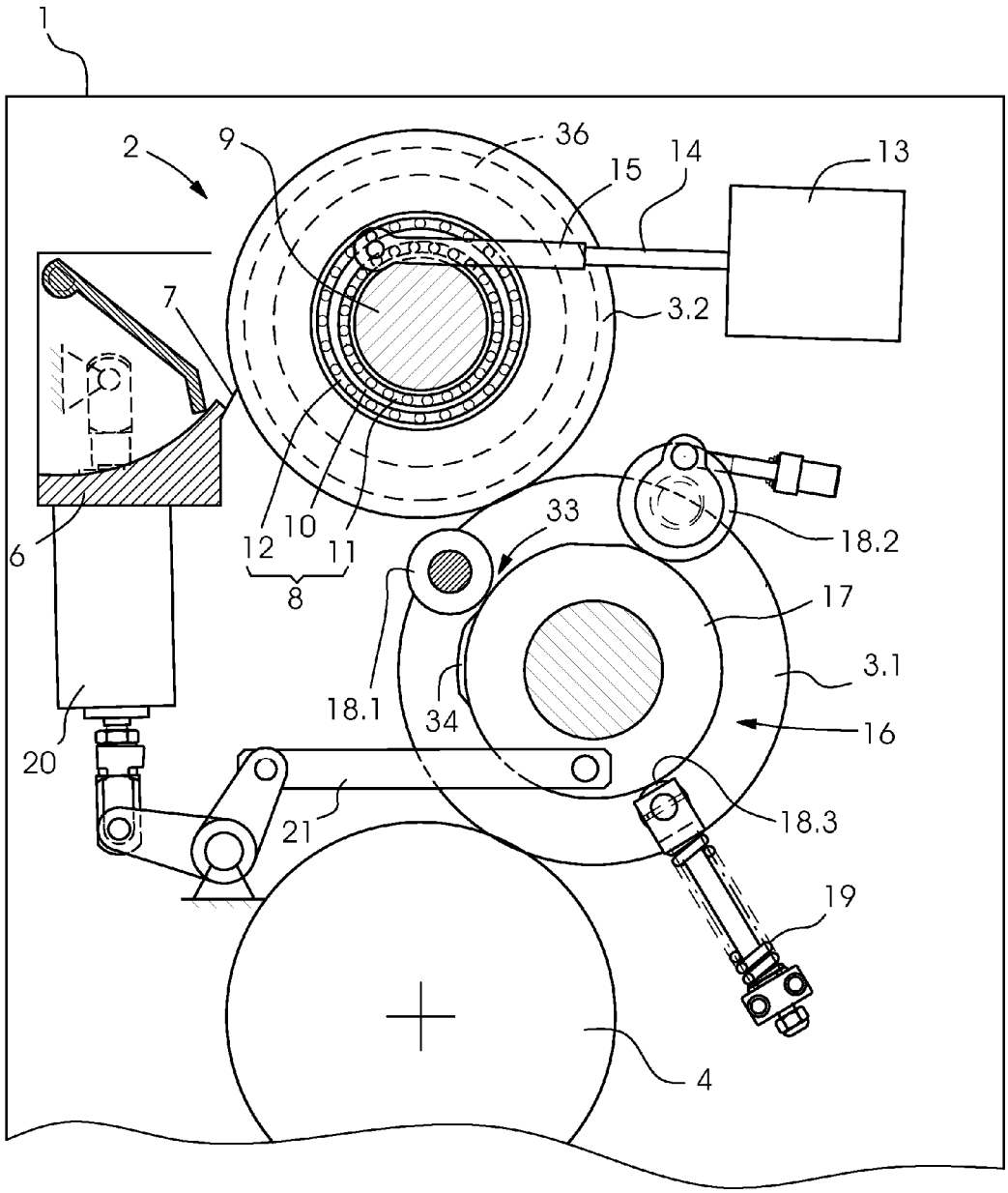
FIGS. 4 and 5 are respective fragmentary, front-elevational and side-elevational views illustrating modifications of the anilox inking unit shown in FIG. 1.
Figure 5:
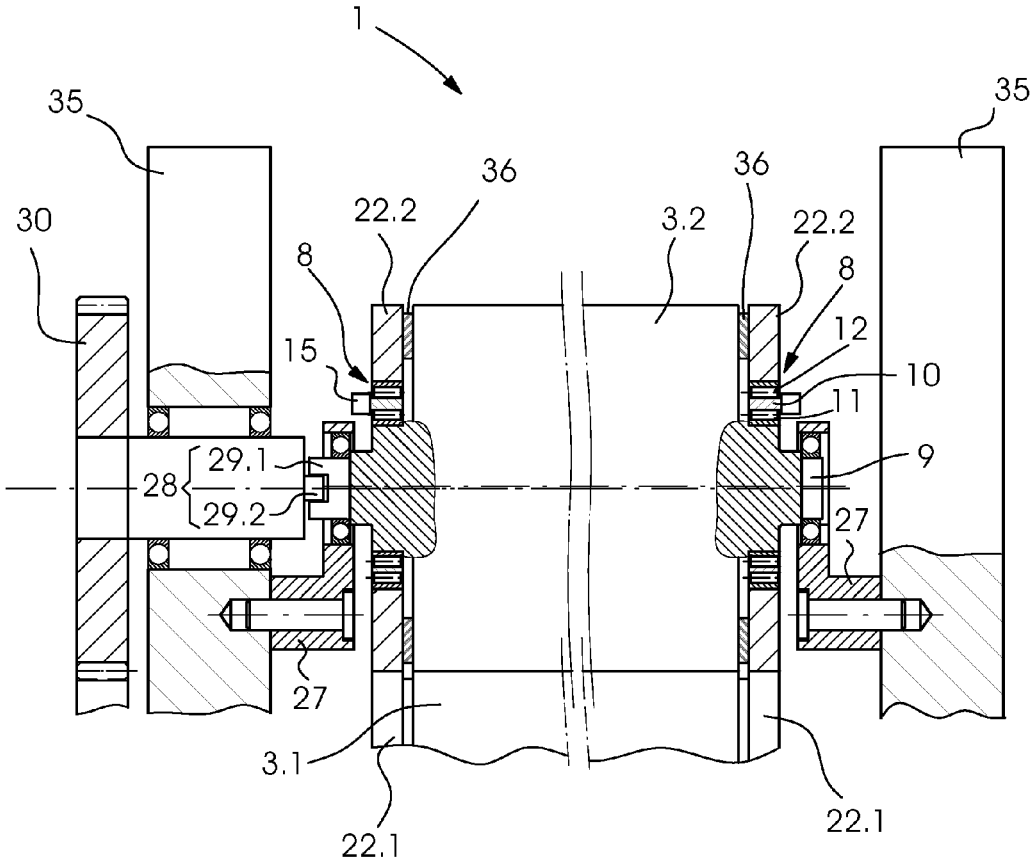

The exemplary embodiment illustrated in FIGS. 4 and 5 differs from the one shown in FIGS. 1 and 2 only in the fact that the coupling 23 has been replaced by a different coupling in which the transmission of a torque from the screen roller 3.2 to the second bearer rings 22.2 and the radial compensation are implemented by a friction-locking connection of the screen roller 3.2 and the respective second bearer ring 22.2. For this purpose, an annular friction coating 36 is provided on the end face of the screen roller 3.2. This friction coating 36 is in frictional contact with the end face of the bearer ring under low slippage.

The invention claimed is:

1. A printing press, comprising:

a first rotary body with a first bearer ring;

a second rotary body with an axle eccentrically supporting a second bearer ring;

said second bearer ring being in rolling contact with said first bearer ring and rotatably coupled to said second rotary body; and an entrainment coupling for connecting said second bearer ring with said second rotary body to fix said second bearer ring against rotation relative to said second rotary body.

2. The printing press according to claim 1, which further comprises a bearing having an eccentric bushing, said second bearer ring being supported on said axle through said bearing.

3. The printing press according to claim 2, wherein said bearing includes a first pivot bearing for supporting said eccentric bushing on said axle and a second pivot bearing for supporting said second bearer ring on said eccentric bushing.

4. The printing press according to claim 1, wherein said entrainment coupling is a compensating coupling for radial compensation.

5. The printing press according to claim 1, which further comprises a spring resiliently supporting said first rotary body.

6. The printing press according to claim 1, wherein said first rotary body is an ink applicator roller and said second rotary body is a screen roller.

7. A printing press, comprising:

a first rotary body with a first bearer ring;

a second rotary body with an axle eccentrically supporting a second bearer ring; and a friction coupling for transmitting a torque from said second rotary body to said second bearer ring by a friction-locking connection of said second bearer ring and said second rotary body;

said second bearer ring being in rolling contact with said first bearer ring.

8. The printing press according to claim 7, wherein said first rotary body is an ink applicator roller and said second rotary body is a screen roller.

* * * * *